US005289924A

United States Patent [19]

Takemoto et al.

[11] Patent Number: 5,289,924

[45] Date of Patent: Mar. 1, 1994

[54] UNIT SUPPORT STRUCTURE FOR GAME MACHINE ISLAND

[75] Inventors: Takatoshi Takemoto; Toshikazu Chida, both of Tokyo; Yoshihide Kurihara, Hanamaki, all of Japan

[73] Assignee: Kabushiki Kaisha Ace Denken, Tokyo, Japan

[21] Appl. No.: 992,201

[22] Filed: Dec. 17, 1992

[30] Foreign Application Priority Data

Dec. 18, 1991 [JP] Japan ..... 3-335146
Dec. 24, 1991 [JP] Japan ..... 3-340984

[51] Int. Cl.[5] ..... A47F 7/00
[52] U.S. Cl. ..... 211/13; 211/189
[58] Field of Search ..... 211/13, 189, 186, 26

[56] References Cited

U.S. PATENT DOCUMENTS 2,727,364 12/1955 Perez ..... 211/189 X
3,968,883 7/1976 Farmer ..... 211/26 X

FOREIGN PATENT DOCUMENTS 3-79321 4/1991 Japan .

*Primary Examiner*—Robert W. Gibson, Jr.
*Attorney, Agent, or Firm*—Lowe, Price, LeBlanc & Becker

[57] ABSTRACT

A unit support frame structure, for a game machine island, comprises a pair of parallel horizontal shelf plates adapted to be attached to a pair of rows of game machines in the island, a plurality of vertical partition frame plates disposed under the shelf plates, two pair of parallel vertical posts mounted on opposite inner ends of the respective shelf plates, and a pair of gate-shape upper support frames connected at opposite lower portions of each support frame to upper end portions of the posts of the respective adjacent pair.

8 Claims, 13 Drawing Sheets

UNIT SUPPORT STRUCTURE FOR GAME MACHINE ISLAND

BACKGROUND OF THE INVENTION

1. Field of the Invention

This invention relates to a unit support structure, for a game machine island, whose individual unit support frames are adapted to be installed in an amusement arcade for supporting a plurality of game machines, such as pachinko machines, as well as ball dispensers and paper currency conveyers.

2. Description of the Related Art

Conventionally, after all of the support frames for a single game machine island are assembled in an amusement arcade, game machines, ball dispensers and paper currency conveyers are installed in order on the respective support frames.

However, partly since all of the support frames must be assembled precisely, and partly since the individual support frames must be connected at many joints, the assembling work is particularly difficult when the game machine island is long or when the working space is small.

Generally, in a pachinko machine island, there is installed a lower tank for collecting out-balls from the individual pachinko machines, and a ball-polishing-and-lifting apparatus for lifting the balls from the lower tank to a ball conveying gutter situated upwardly of the pachinko machine island, while polishing them. For example, in our coassigned prior application, Japanese Patent Application No. HEI 3-79321, the polishing-and-lifting apparatus is mounted within the support frames of the pachinko machine island.

However, if the island is divided into blocks or the polishing-and-lifting apparatus is mounted independently to facilitate precise and effective assembly of the island, it would be difficult to mount the polishing-and-lifting apparatus in harmony with the rest of the island.

SUMMARY OF THE INVENTION

It is therefore an object of this invention to provide a unit support frame structure, for a game machine island, which can be assembled easily and precisely.

According to a first aspect of the invention, there is provided a unit support frame structure for a game machine island, comprising: a pair of parallel horizontal shelf plates adapted to be attached to a pair of game machine in the island; a plurality of vertical partition frame plates disposed under the shelf plates; two pairs of parallel vertical posts mounted on opposite inner ends of the respective shelf plates; and a pair of gate-shaped upper support frames connected at opposite lower portions to upper end portions of the respective adjacent pair.

The unit support frame structure may further comprise a pair of vertical frame plates each of which extends downwardly from a lower portion of the respective upper support frame through a gap between the respective pair of adjacent vertical posts.

The unit support frame structure may further comprise a pair of horizontal support plates mounted between the two pairs of vertical frame posts, and a pair of lower support frames to which respective lower ends of the partition frame plates are connected.

The unit support frame structure may further comprise a pair of floor attachment plates and a pair of base plates which are mounted between the lower support frames at opposite ends and are vertically movably connected to the floor attachment plate.

According to a second aspect of the invention, there is provided a ball-polishing-and-lifting-unit attaching apparatus for a pachinko machine island in which a ball polishing and lifting unit including a lower tank, a ball lifting polisher and an upper tank is located centrally, the apparatus comprising: a support base for supporting thereon the entire ball polishing and lifting unit; a pair of support frames fixed to the support base; an attachment plate adapted to be fixed to a floor of an amusement arcade by anchor bolts; and an adjuster vertically adjustably mounted between the attachment plate and the support frames.

The support frames may be fixed respective to opposite lower portions of the support base.

The ball-polishing-and-lifting-unit attaching apparatus may further comprise a unit supporting frame member which constitutes a framework of the pachinko machine island and whose one end is fixed at its lower portion to one side of each of the support frames.

The ball-polishing-and-lifting-unit attaching apparatus may further comprise a unit supporting frame member which constitutes a framework of the pachinko machine island whose opposite ends are fixed at their lower portions to one side of each of the support frames.

With this arrangement, it is possible to install the individual game machine and the individual ball dispenser on the two shelf plates of each unit support frame easily and precisely. Likewise it is possible to install the paper currency conveyer on the two support plates of each unit support frame easily and precisely. Even when each unit support frame is brought into the game arcade from one end or the other, it is possible to assemble individual support frames in connected form easily by joining the two support posts at one side with those at the other side of the adjacent support frame and by adjusting the height of the whole support frame. Further, the game machine island for each unit can be assembled simply by mounting an upper curtain plate and a lower curtain plate respectively between the two upper support frames and between the two lower partition frame plates. Furthermore each unit such as a game machine can be repaired from the rear side without difficulty.

In addition, by vertically adjusting the individual support frames, which constitute each block of the pachinko machine island, using an adjuster, it is possible to control the level of the installed individual unit. By fixing the opposite ends of the support base for the polishing-and-lifting apparatus to the respective upper portions of the two support frames secured to the lower portions of the two unit support frames, it is possible to vertically adjust the individual support frames in level so that each unit can be placed at a proper posture (including a tilt) with respect to the whole island.

DETAILED DESCRIPTION

Figure 1:
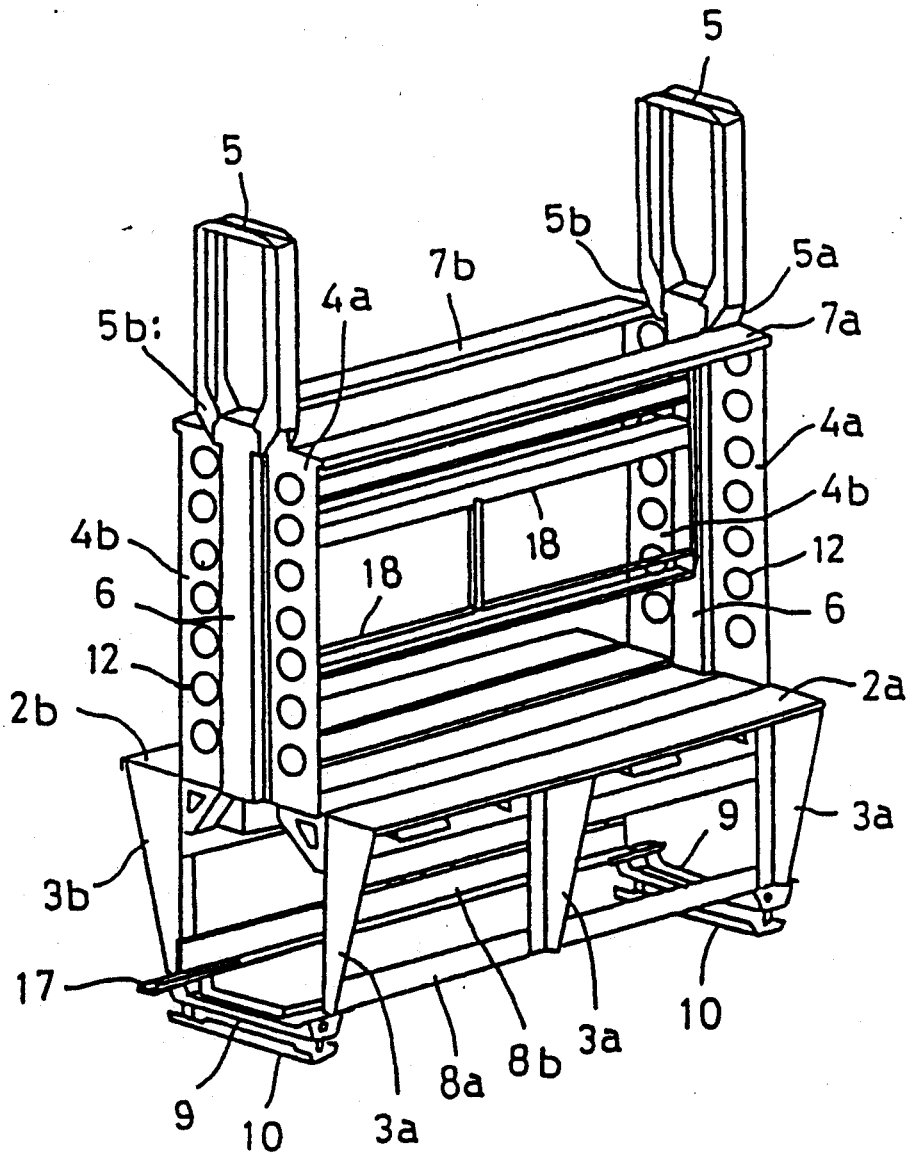
FIG. 1 is a perspective view of a unit support frame structure according to a first embodiment of this invention.
Figure 2:
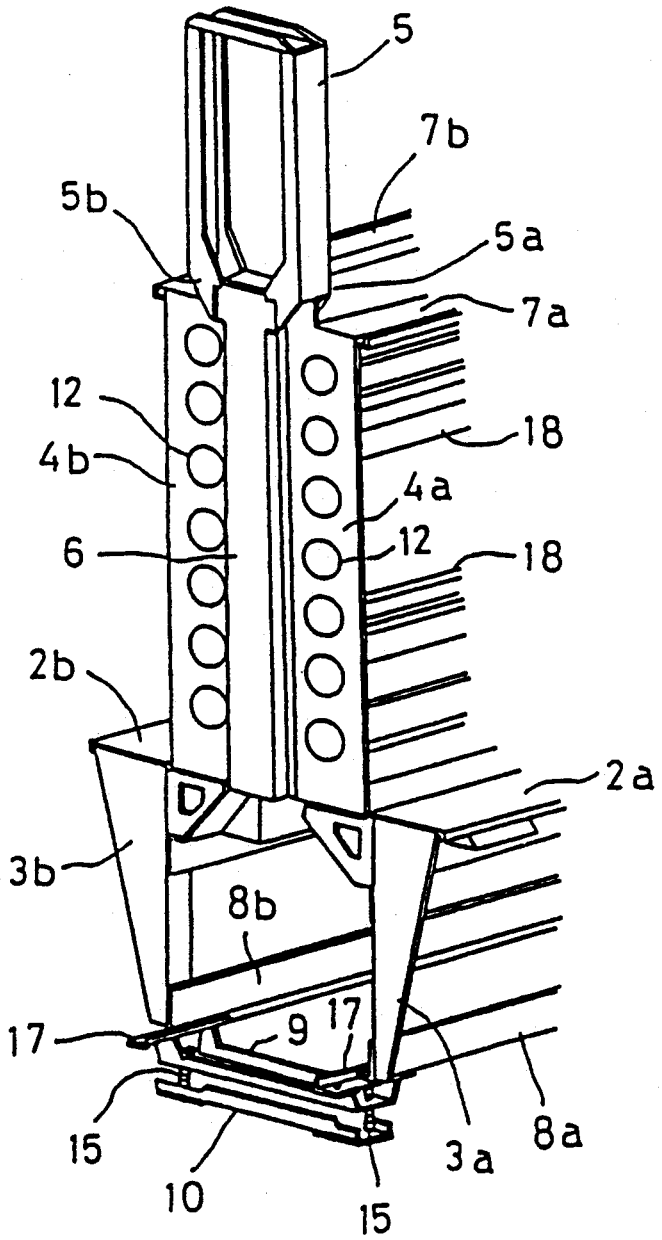
FIG. 2 is a fragmentary enlarged perspective view of FIG. 1.
Figure 3A:
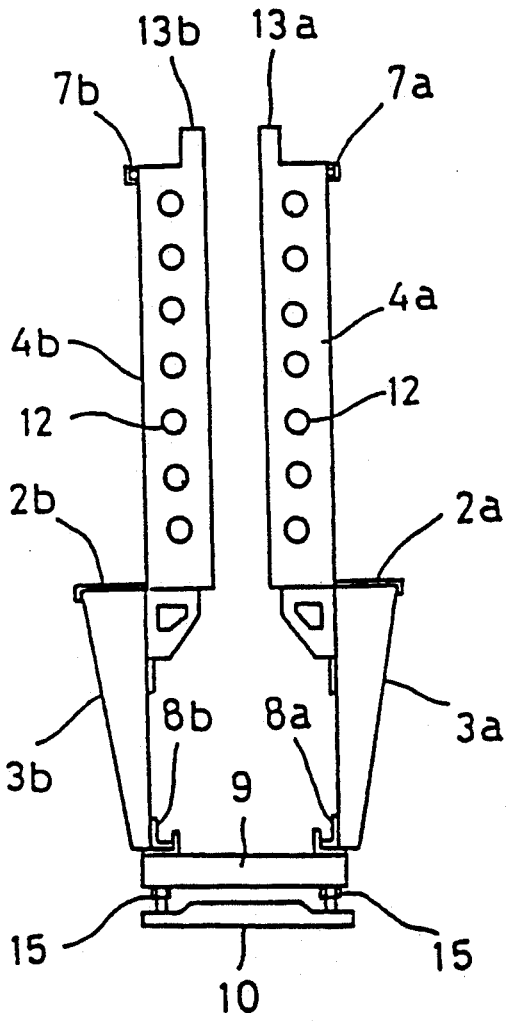
FIG. 3(*a*) and FIG. 3(*b*) show a fragmentary exploded side view of FIG. 2.
Figure 3B:
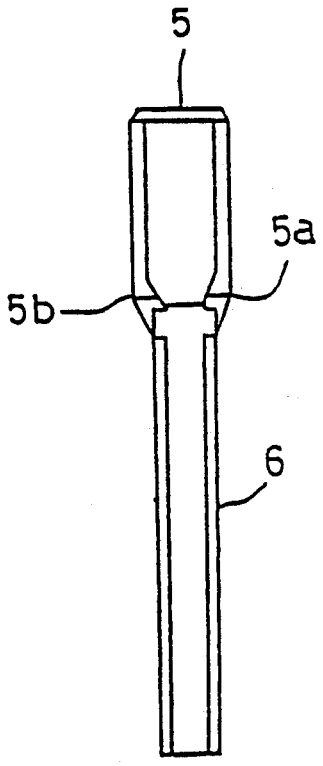
Figure 4:
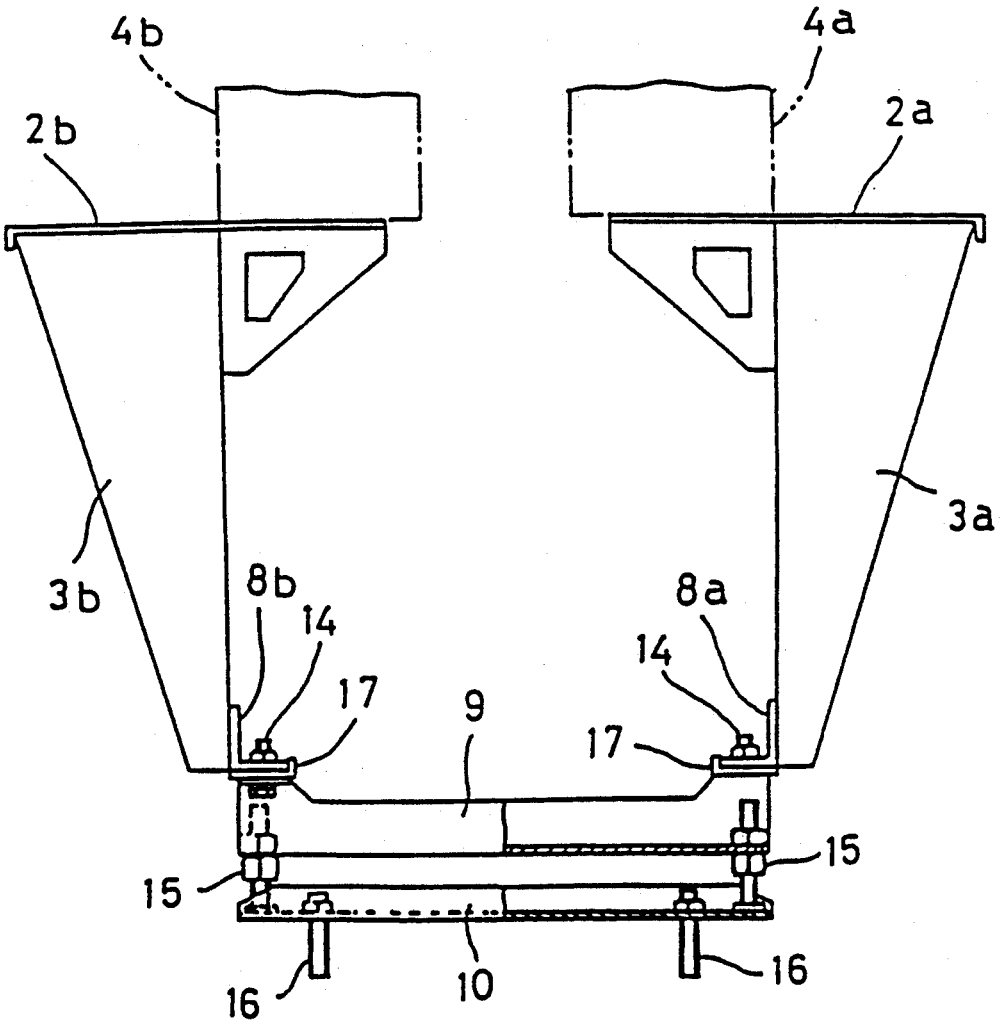
FIG. 4 is a fragmentary side view, partially in cross section, of FIG. 2.

FIGS. 1 through 6 show a first embodiment of this invention. FIG. 1 is a perspective view of a unit support frame structure for one unit structure of a game machine island. A pair of parallel shelf plates 2*a*, 2*b*, on which a game machine 1, such as a pachinko machine, and a ball dispenser 11 are to be supported, are provided horizontally. Under each of the shelf plates 2*a*, 2*b*, three partition frame plates 3*a*, 3*a*, 3*a* and 3*b*, 3*b*, 3*b* are provided so as to extend vertically from opposite ends of the shelf plate 2*a*, 2*b* and a central portion thereof. A lower frame 8*a*, 8*b* is attached horizontally to the inner lower end portions of the three partition plates 3*a*, 3*a*, 3*a* and 3*b*, 3*b*, 3*b* associated with each shelf plate 2*a*, 2*b*. A pair of parallel vertical plate-like posts 4*a*, 4*a* and 4*b*, 4*b* having a multiplicity of circular holes 12 are mounted on the inner upper end portions of each shelf plate 2*a*, 2*b*. A pair of support plates 7*a*, 7*b* are mounted horizontally between the upper end portions of one pair of posts 4*a*, 4*a* and between the upper end portions of the other pair of posts 4*b*, 4*b*, respectively. A gate-shaped (generally inverted U-shape) upper support frame 5 is connected at opposite lower ends 5*a*, 5*b* to the respective upper ends 13*a*, 13*b* of the posts 4*a*, 4*b* of each adjacent pair of vertical posts. A frame plate 6 is mounted between each adjacent pair of the posts 4*a*, 4*b*, extending vertically downwardly from the lower portion of the respective upper support frame 5. Below each end of one lower frame 8*a* and the respective associated end of the other lower frame 8*b*, a base plate 9 having a generally U-shape cross section is connected by means of bolts and bolts 14 (FIG. 4). Each base plate 9 can be vertically adjusted with respect to an associated floor attachment plate 10, which is disposed under the base plate 9, by a pair of adjuster 15, 15 mounted at opposite ends of the base plate 9. Each lower attachment plate 10 is adapted to be attached to the floor surface by means of anchor bolts 16. Between each adjacent pair of ends of the lower frames 8*a*, 8*b* and the opposite ends of the associated base plate 9, a pair of connector plates 17, 17 each for connection with a separate unit support frame structure to be assembled adjacently is disposed.

Figure 5:
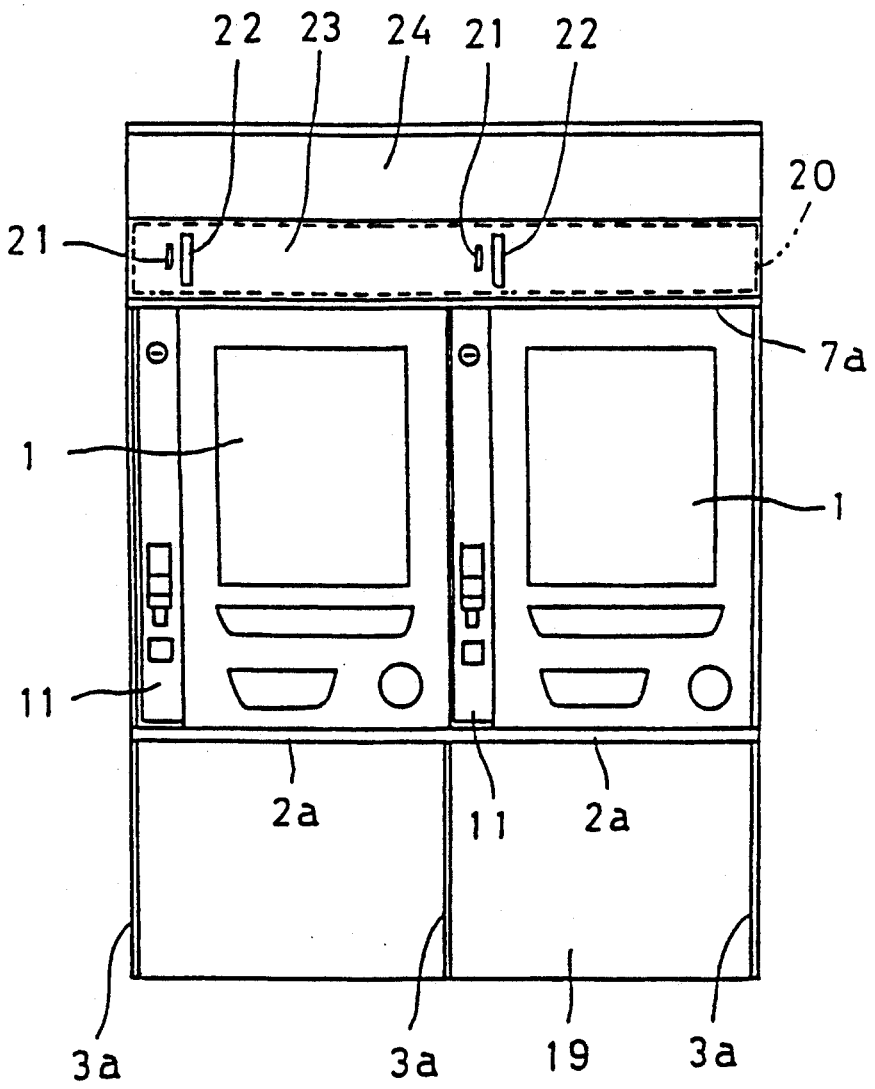
FIG. 5 is a fragmentary front view of a game machine island.
Figure 6:
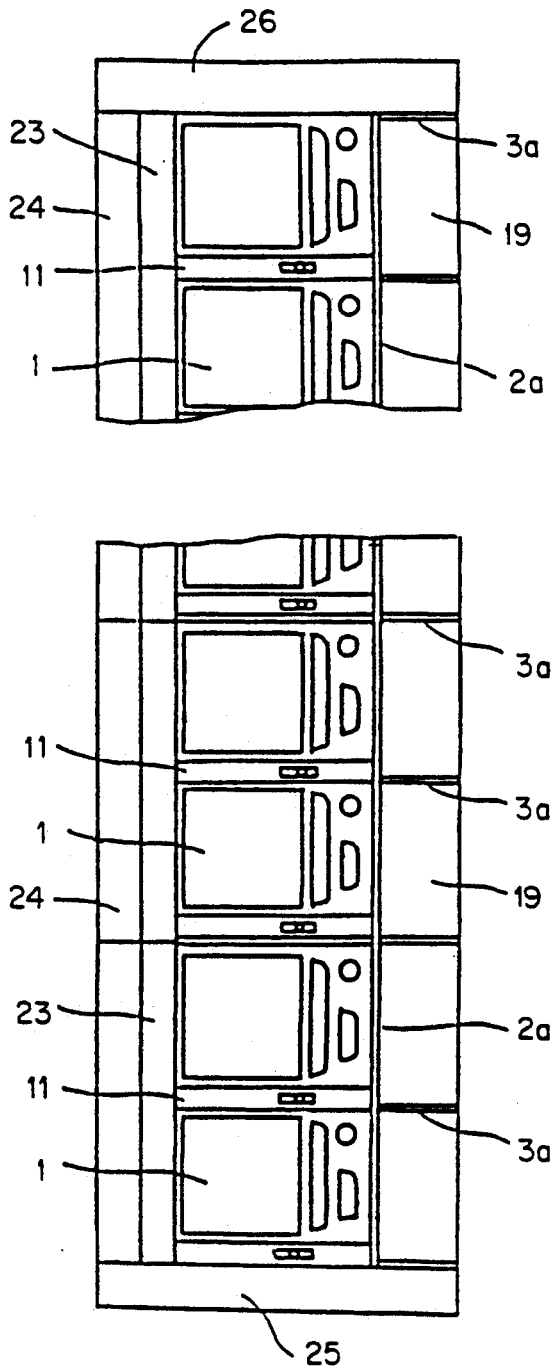
FIG. 6 is a front view of the whole game machine island.

The two frame plates 6, 6 are connected to a plurality of horizontal bars 18 to form a wide gap between the parallel shelf plates 2*a*, 2*b* upwardly thereof. Under the shelf plates 2*a*, 2*b*, there are mounted lower curtain plates 19 (FIG. 5). A coin/paper-currency conveyor 20 constituting one unit structure is attached to the top of two support plates 7*a*, 7*b*. An uppermost curtain plate 24 and a second upper curtain plate 23 having a coin inlet 21 and a paper currency inlet 22 are mounted between the two upper support frames on each side. The circular holes 12 formed in each post 4*a*, 4*b* are for wiring purposes. Thus, as shown in FIG. 5, one unit structure of the game machine island is constructed. Further, as shown in FIG. 6, a plurality of the identical unit structures are connected to one another on each side of the island, and at each end of the island an island decoration, in which a stacker is mounted for supporting a coin/paper-currency transferring apparatus and a money changer, is mounted, thus constituting a single game machine island.

Since each unit support frame structure is a skeleton framework composed of three blocks, i.e. a block of the two shelf plates 2*a*, 2*b*, a block of the two posts 4*a*, 4*b* and a block of the two upper support frames 5, 5, it can be assembled easily. Even when each unit support frame is brought into the game arcade from one end or the other, it is possible to connect the two posts 4*a*, 4*b* of one side with the two support posts 4*a*, 4*b* of the other side of the adjacent unit support frame structure, and then to adjust the height of the unit support frame structure, thus assembling the individual unit support frame structures in connected form simply. On the two shelf plates 2*a*, 2*b* of each unit support frame structure, a game machine 1 or a ball dispenser can be installed easily and precisely, and on the two support plates 7*a*, 7*b*, a paper currency conveyer for two units can be installed easily and precisely. Then between the two upper support frames 5, 5, the uppermost and the second upper curtain plates 23, 24 can be mounted, and to the partition frame plates 3*a*, 3*b*, the lower curtain plates 19 can be mounted, thus assembling a single unit structure of the game machine island with ease. Further, each game machine 1 can be repaired from the rear side without difficulty.

A second embodiment of this invention will now be described.

Figure 7:
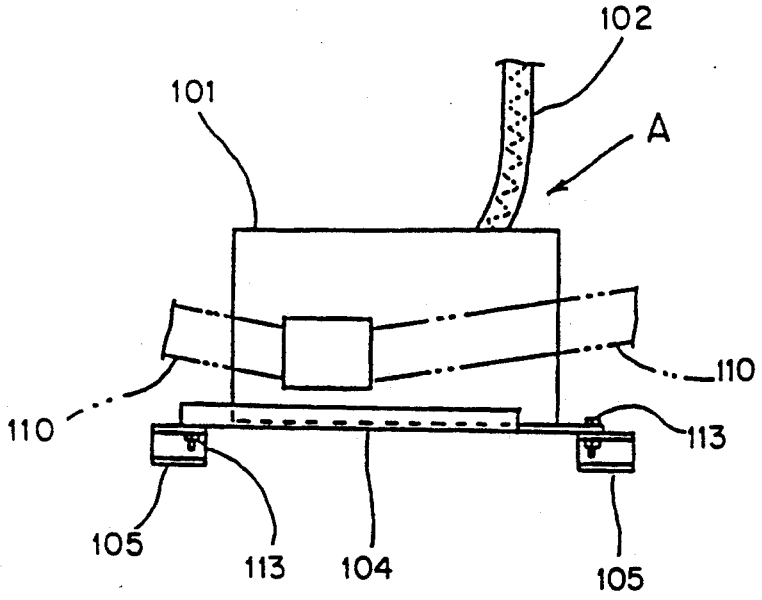
FIG. 7 is a front view showing a main portion of a second embodiment of the invention.
Figure 8:
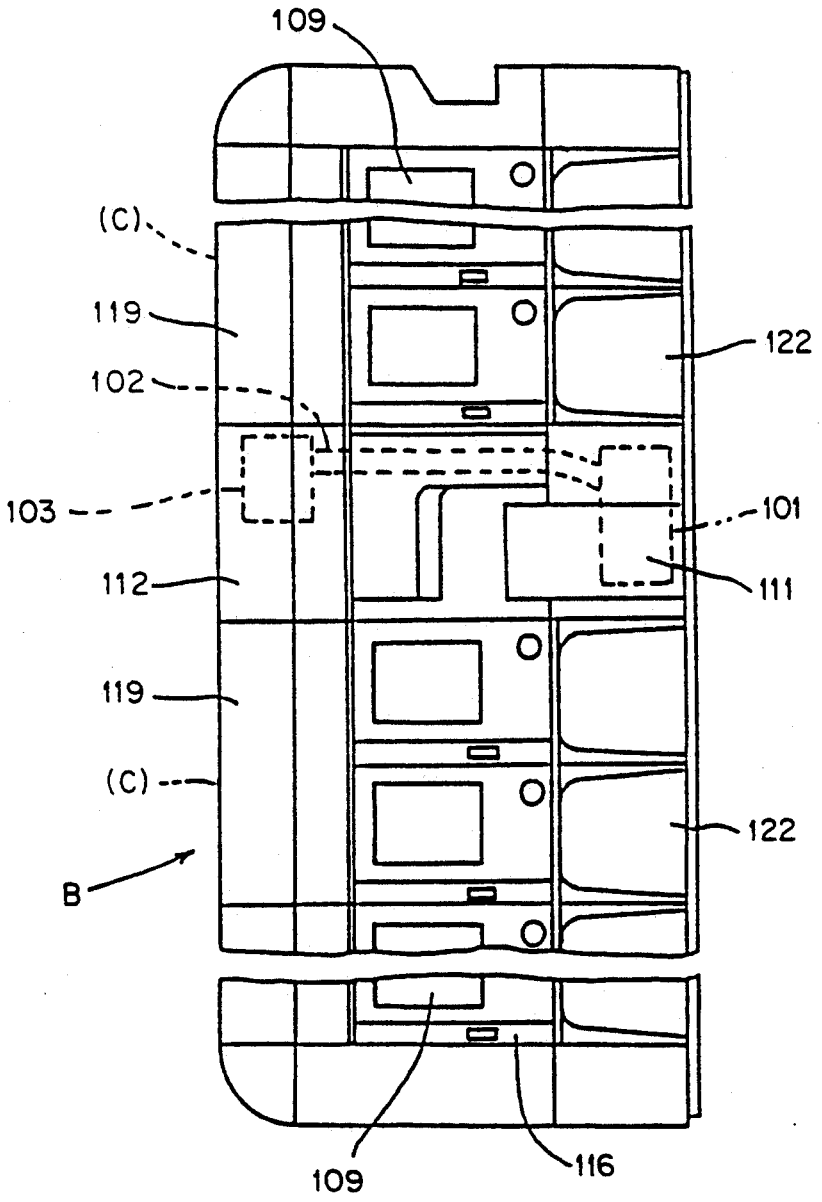
FIG. 8 is a front view showing a pachinko machine island.

FIG. 8 is a fragmentary front view showing a single pachinko machine island. The pachinko machine island B is divided into blocks, and centrally between the blocks, a ball polishing-and lifting apparatus is installed. In the ball polishing-and-lifting apparatus A, a lifter-polisher 102 is connected at its lower end to a lower tank 101 communicating with a collecting gutter 110 (FIG. 7) for collecting pachinko balls from the individual pachinko machines 109, and at its upper end to an upper tank 103 for distributing pachinko balls to the individual pachinko machines 109. Associated with the polishing-and-lifting apparatus A, a ball counter 111 and upper curtain plates 112 are provided so as to have a height equal to the height of the pachinko machine island B. As shown in FIG. 7, a horizontally elongated support base 104 is fixed to the lower surface of the lower tank 101, being connected at its four corners to support frames 105 by means of nuts and bolts 113.

Figure 9:
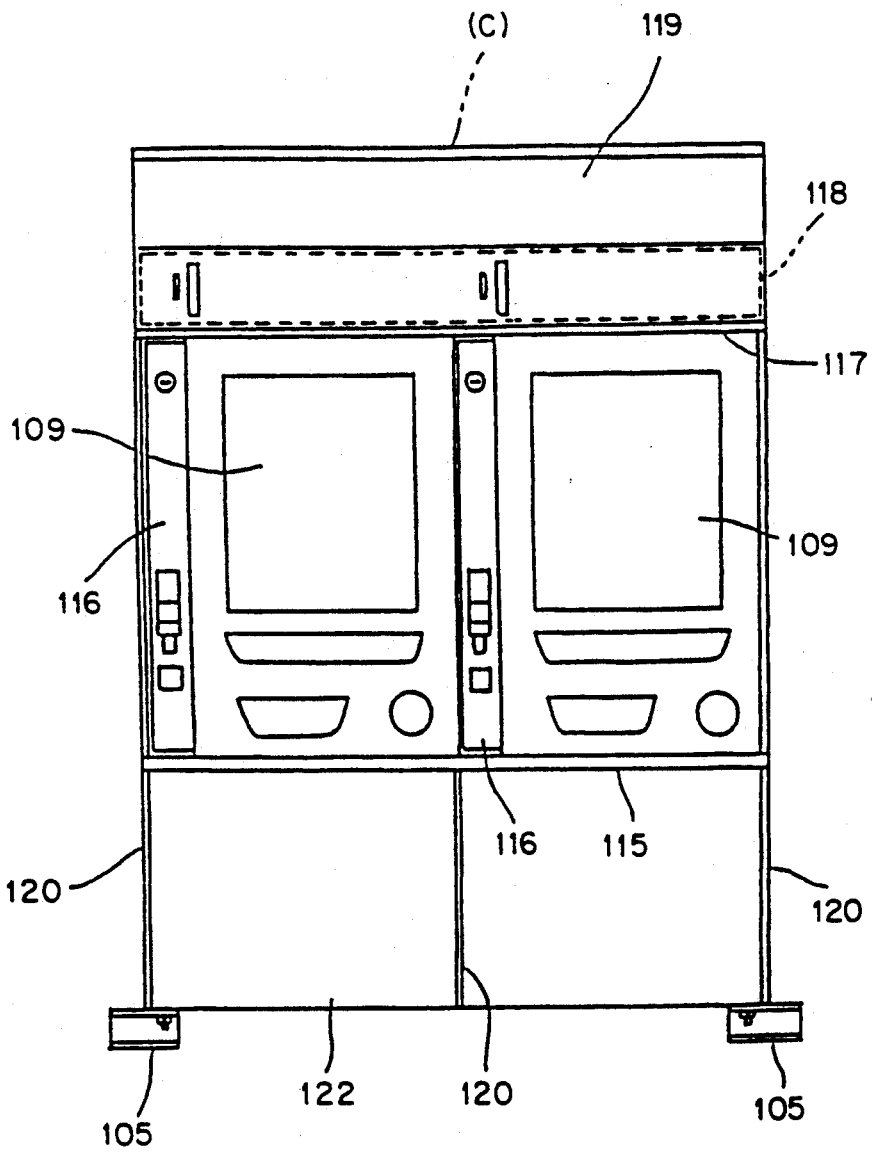
FIG. 9 is a front view showing one block of the pachinko machine island.
Figure 10:
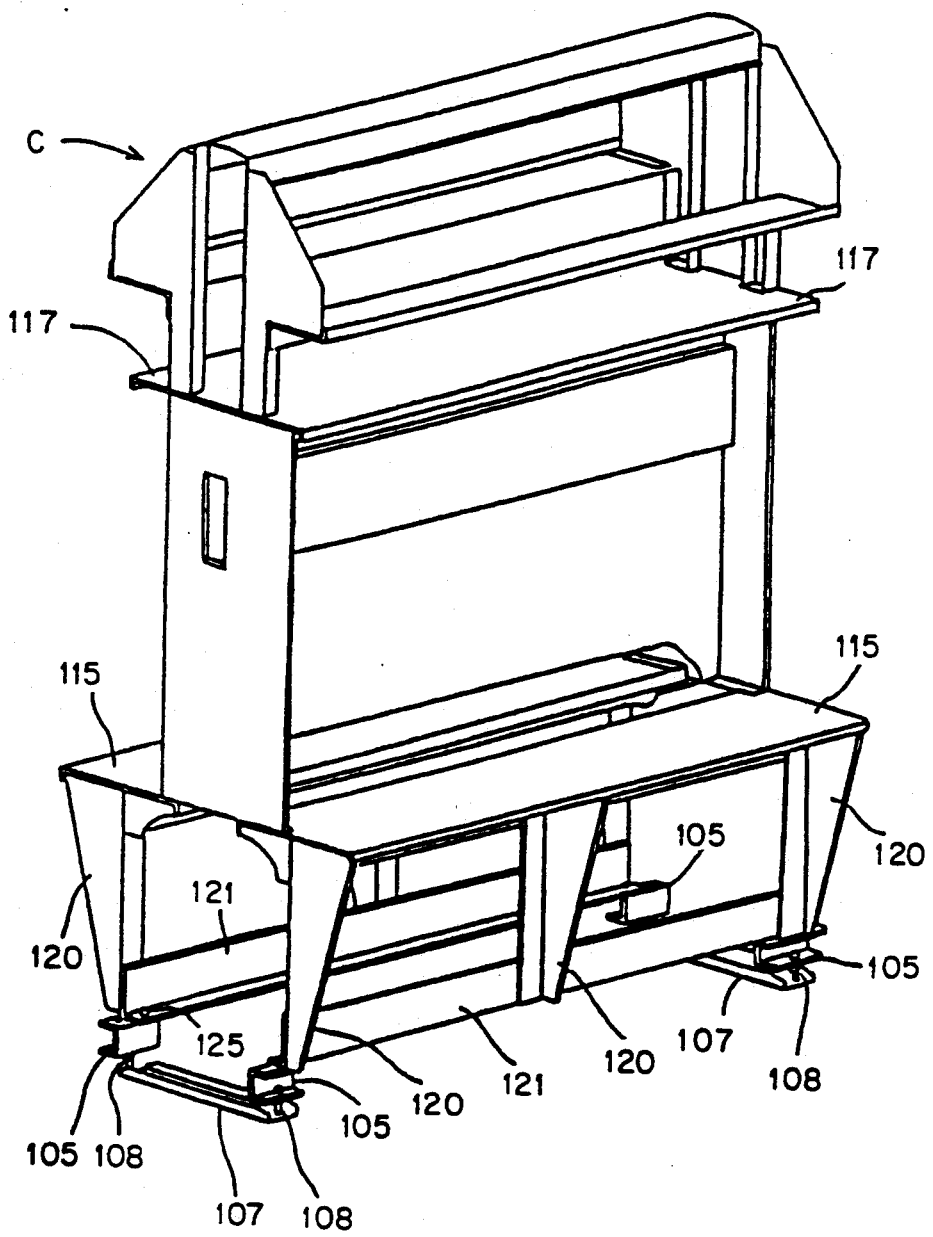
FIG. 10 is a perspective view showing a unit support frame.
Figure 11:
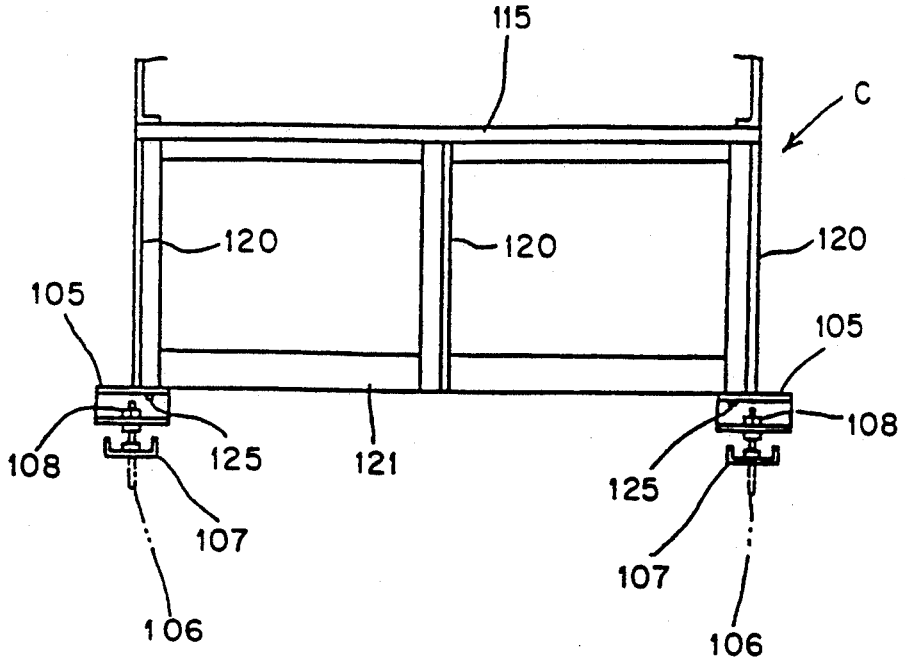
FIG. 11 is a fragmentary front view of FIG. 10.
Figure 12:
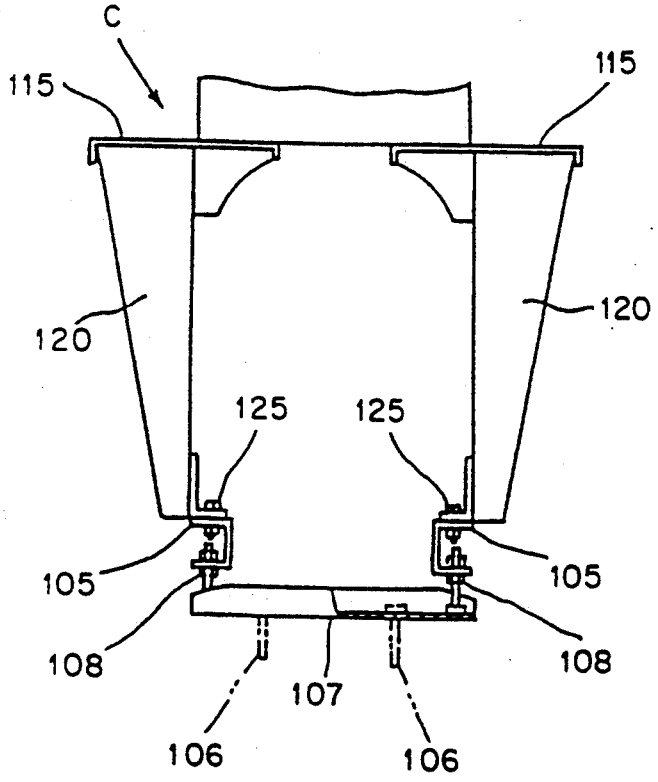
FIG. 12 is a side view of FIG. 11 as seen from the left side.
Figure 13:
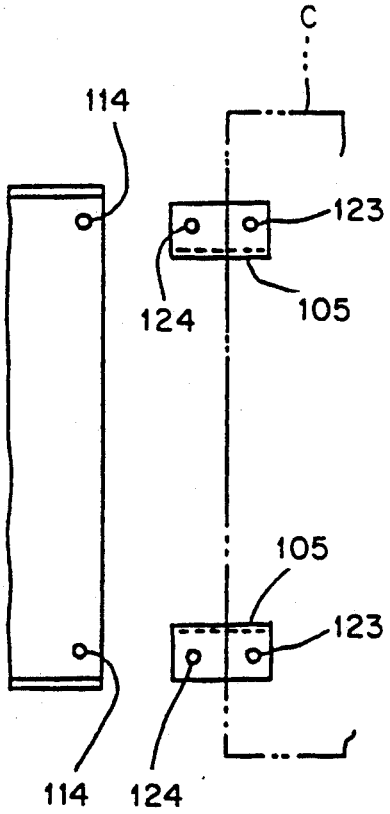
FIG. 13 is a plan view, with parts broken away, of a main portion of the unit support frame.

FIG. 10 shows a unit support frame structure C. On two shelf plates 115, two ball dispensers 116 and/or pachinko machines 109 are installed on each side, and on an upper support plate 117, a pair of coin/paper-currency conveyers 118 for one unit are mounted in opposite directions. Upwardly of the upper support plate 117, upper curtain plates 119 are mounted, and between the lower end portions of three support frame plates 120 extending vertically downwardly from the two shelf plates 115, lower frames 121 are respectively mounted horizontally and also lower curtain plates 122 are mounted, thus constituting one block of the pachinko machine island B as shown in FIG. 9. The opposite lower end portions of the two lower frames 121 are secured to the respective support frames 105, each having a generally U-shape cross section, by means of nuts and bolts 125, each bolt being inserted through the hole 123 of the holes 123, 124 (FIG. 13) formed in the upper side of the individual support frame 105. To the other upper surfaces of the support frames 105, the opposite ends of the support base 104 are secured by means of nuts and bolts 113, each inserted through the holes 124, 114. Between the lower portion of the respective support frame 105 and the associated one end of each attachment plate 107, there is mounted an adjuster 108 composed of a bolt and two nuts. The attachment plate 107 is adapted to be secured to the floor of the amusement arcade by means of an anchor bolt 106.

Each unit support frame structure C constituting the individual block of the pachinko machine island B is vertically adjustable, by four adjusters 108, with respect to the respective attachment plate 107 secured to the floor by means of an anchor bolt 106, thus adjusting the level of installation of the individual game machine. By fixing each of the opposite ends of the support base 104 of the polishing-and-lifting apparatus A to one upper side of the respective support frame 105 fixed to the lower portion of each unit support frame structure C, it is possible to vertically adjust the individual unit support frame structures C by the adjusters 108 to such a level as to harmonize with the whole island.

As described above, each unit support frame structure constituting a single unit structure of a skeleton framework of the game machine island is composed of three blocks, i.e. a block of the two shelf plates 2*a*, 2*b*, a block of the two posts 4*a*, 4*b* and a block of the two upper support frames 5, which can be assembled without difficulty. Even when each unit support frame is brought into the game arcade from one end or the other, it is possible to assemble the individual unit support frame structure in connected form with the adjacent unit support frame structure simply by adjusting the height of the unit support frame structure. Further, each game machine 1 can be repaired from the rear side with ease.

In the case where each unit support frame structure C constituting the individual block of the pachinko machine island B can be vertically adjusted by the adjusters 108 with respect to the attachment plate 107 secured to the floor surface by the anchor bolts 106, it is possible to adjust the level of installation of the individual unit support frame structure. By fixing each of the opposite ends of the support base 104 of the polishing-and-lifting apparatus A to one upper side of the respective support frame 105 fixed to the lower portion of each unit support frame structure C, it is possible to vertically adjust the individual unit support frame structures C effectively and precisely by the adjusters 108 to such a level as to harmonize with the whole island.

What is claimed is:

1. A unit support frame structure for a game machine island comprised of a pair of rows of game machines, which comprises:

(a) a pair of parallel horizontal shelf plates adapted to be attached to said pair of rows of game machines in the island, respectively;

(b) a plurality of vertical partition frame plates disposed under said shelf plates;

(c) two pairs of parallel vertical posts mounted on opposite inner ends of the respective shelf plates and each having an upper end; and (d) a pair of gate-shape upper support frames having opposite lower portions which are connected to the adjacent upper end portions of the pair of said posts.

2. A unit support frame structure according to claim 1, further comprising a pair of vertical frame plates each of which extends downwardly from a lower portion of the respective upper support frame through a gap between said adjacent pair of posts.

3. A unit support frame structure according to claim 1, further comprising a pair of horizontal support plates mounted between said two pairs of vertical frame posts, and a pair of lower support frames to which respective lower ends of said partition frame plates are connected.

4. A unit support frame structure according to claim 3, further comprising a pair of floor attachment plates and a pair of base plates which are mounted between said lower support frames at opposite ends and are vertically movably connected to said floor attachment plate.

5. A ball-polishing-and-lifting-unit attaching apparatus for a pachinko machine island in which a ball polishing and lifting unit including a lower tank, a ball lifting polisher and an upper tank is located centrally, said apparatus comprising:

(a) a support base for supporting thereon the entire ball polishing and lifting unit;

(b) a pair of support frames fixed to said support base;

(c) an attachment plate adapted to be fixed to a floor of an amusement arcade by anchor bolts; and (d) an adjuster vertically adjustably mounted between said attachment plate and said support frames.

6. A ball-polishing-and-lifting-unit attaching apparatus according to claim 5, wherein said support frames are fixed respectively to opposite lower portions of said support base.

7. A ball-polishing-and-lifting-unit attaching apparatus according to claim 6, further comprising a unit supporting frame member which constitutes a framework of the pachinko machine island and whose one end is fixed at its lower portion to one side of each said support frame.

8. A ball-polishing-and-lifting-unit attaching apparatus according to claim 6, further comprising a unit supporting frame member which constitutes a framework of the pachinko machine island whose opposite ends are fixed at their lower portions to one side of each of said support frames.

* * * * *